US010640351B2

(12) United States Patent
Virgili et al.

(10) Patent No.: US 10,640,351 B2
(45) Date of Patent: May 5, 2020

(54) CAP ORIENTATION

(71) Applicant: Tetra Laval Holdings & Finance S.A., Pully (CH)

(72) Inventors: Magnus Virgili, Malmö (SE); Håkan Berg, Tomelilla (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 215 days.

(21) Appl. No.: 15/571,959

(22) PCT Filed: May 3, 2016

(86) PCT No.: PCT/EP2016/059933
§ 371 (c)(1),
(2) Date: Nov. 6, 2017

(87) PCT Pub. No.: WO2016/177750
PCT Pub. Date: Nov. 10, 2016

(65) Prior Publication Data

US 2018/0086616 A1 Mar. 29, 2018

(30) Foreign Application Priority Data

May 7, 2015 (SE) ..... 1550588

(51) Int. Cl.
*B67B 3/20* (2006.01)
*B67B 3/26* (2006.01)

(52) U.S. Cl.
CPC ..... *B67B 3/20* (2013.01); *B67B 3/264* (2013.01)

(58) Field of Classification Search
CPC ..... B67B 3/264; B67B 3/261; B67B 3/20
(Continued)

(56) References Cited

U.S. PATENT DOCUMENTS 2,804,225 A 8/1957 Lee
4,156,491 A 5/1979 Lyon
(Continued)

FOREIGN PATENT DOCUMENTS

DE 44 05 950 8/1995
DE 102009060625 A1 6/2011
(Continued)

OTHER PUBLICATIONS

International Preliminary Report on Patentability for International Application No. PCT/EP2016/05624, dated Apr. 19, 2017 in 19 pages.
(Continued)

*Primary Examiner* — Chelsea E Stinson
*Assistant Examiner* — Himchan "Aiden" Song
(74) *Attorney, Agent, or Firm* — Knobbe, Martens, Olson & Bear, LLP

(57) ABSTRACT

A method and apparatus for applying a cap to a container may include arranging a first cap in relation to the neck portion of a first container, such that a threaded portion of the first cap faces a complementary threaded neck portion of the first container. Further, a symmetry axis of the first cap and a symmetry axis of the neck portion of the first container may be aligned. The first cap may be rotated around its symmetry axis to a pre-recorded initial angular position. The first cap may be applied to the neck portion by moving the cap towards the threaded neck portion or vice versa along their symmetry axes and by rotating the first cap in a direction of engagement with the threaded neck part. A path length of the first cap may be recorded in relation to its initial angular position after which it has completely engaged the complementary threaded neck portion and reached a bottom part of the neck portion. If the recorded path length for the first cap deviates from a predefined value, the initial angular
(Continued)

Figure 1:
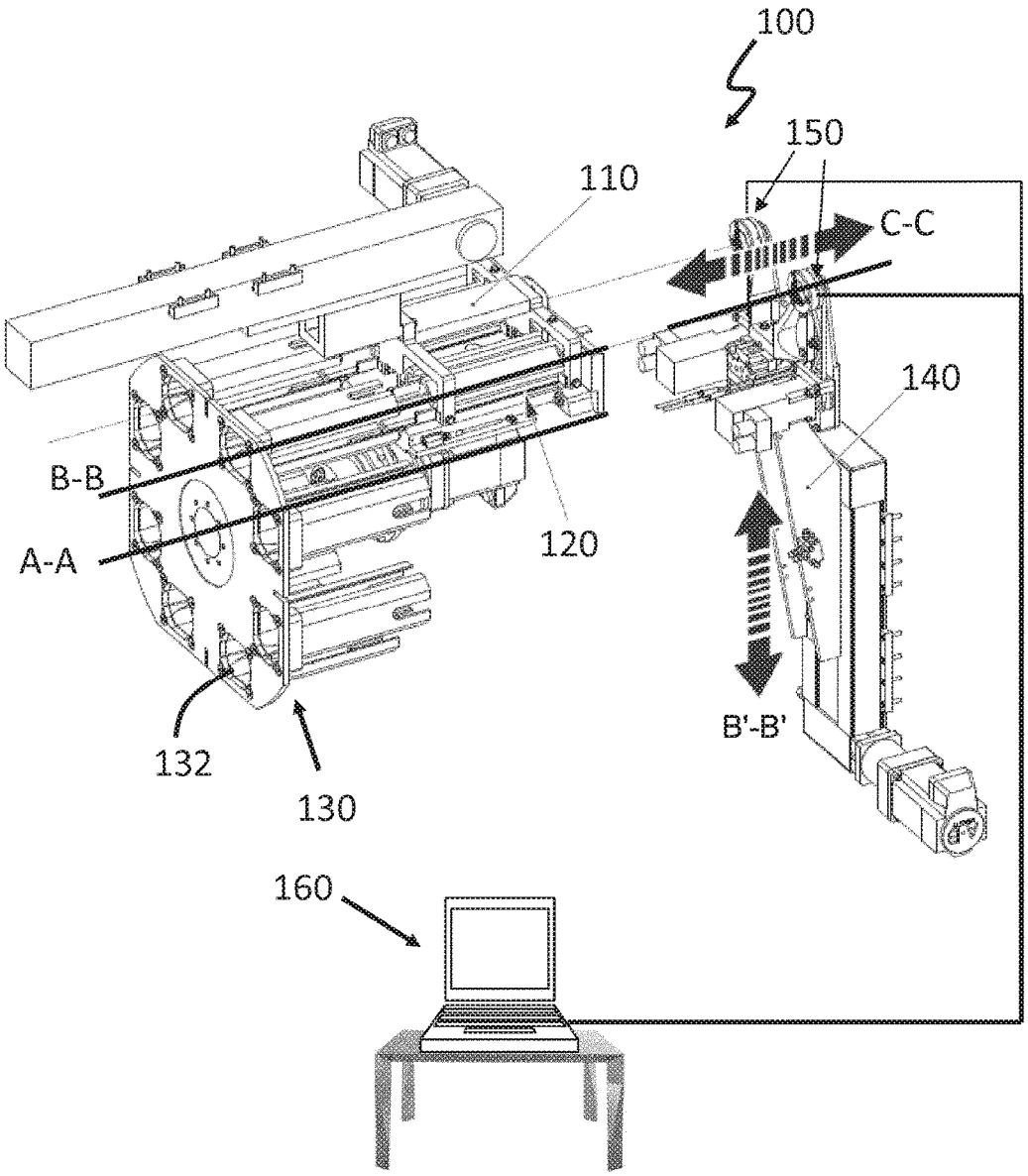

position of a second cap may be adjusted to a new initial angular position.

17 Claims, 8 Drawing Sheets

(58) Field of Classification Search
USPC ..... 53/490, 317, 331.5, 75, 76
See application file for complete search history.

(56) References Cited

U.S. PATENT DOCUMENTS

| | | | | | |
|---|---|---|---|---|---|
| 4,716,772 | A * | 1/1988 | Bubeck | B67B 3/261 | 73/847 |
| 5,048,711 | A | 9/1991 | Weiss et al. | | |
| 5,301,488 | A | 4/1994 | Ruhl et al. | | |
| 5,321,935 | A | 6/1994 | Spatz et al. | | |
| 5,588,545 | A | 12/1996 | King | | |
| 6,105,343 | A * | 8/2000 | Grove | B65B 7/2835 | 53/490 |
| 6,510,675 | B1 | 1/2003 | Straessler | | |
| 7,836,669 | B1 * | 11/2010 | Cassil | B67B 3/20 | 220/288 |
| 7,938,282 | B1 | 5/2011 | Hawry | | |
| 8,746,486 | B2 | 6/2014 | Del Solar et al. | | |
| 8,955,292 | B2 * | 2/2015 | Schraudolph | B67B 3/2006 | 53/306 |
| 9,417,145 | B2 * | 8/2016 | Cochran | G01N 21/9081 | |
| 9,623,990 | B2 * | 4/2017 | Cirio | B65B 7/2842 | |
| 2002/0148205 | A1 * | 10/2002 | Takebe | B67B 3/20 | 53/490 |
| 2011/0083405 | A1 * | 4/2011 | Dewert | B67B 3/20 | 53/490 |
| 2011/0290755 | A1 | 12/2011 | Taber et al. | | |
| 2012/0174536 | A1 | 7/2012 | Schwarz | | |
| 2013/0014369 | A1 * | 1/2013 | Schulthess | B67B 3/26 | 29/407.1 |
| 2015/0033667 | A1 * | 2/2015 | Cirio | B65B 7/2842 | 53/329 |
| 2018/0202802 | A1 * | 7/2018 | Angres | B67B 3/261 | |

FOREIGN PATENT DOCUMENTS

| | | | | |
|---|---|---|---|---|
| EP | 1132331 | A1 | 9/2001 | |
| EP | 1 270 433 | | 1/2003 | |
| EP | 1 508 527 | | 2/2005 | |
| EP | 2832680 | A1 | 2/2015 | |
| EP | 3031773 | A1 * | 6/2016 | B65B 7/2835 |
| GB | 1 449 174 | | 9/1976 | |
| JP | H06-115591 | | 4/1994 | |
| JP | H11-124196 | | 5/1999 | |
| JP | 2000-327086 | | 11/2000 | |
| JP | 2002019884 | A * | 1/2002 | B67B 3/261 |
| JP | 2003205998 | A * | 7/2003 | B67B 3/261 |
| JP | 2009008637 | A * | 1/2009 | G01N 21/909 |
| JP | 2011-195194 | | 10/2011 | |
| JP | 2011195194 | A | 10/2011 | |
| RU | 34523 | U1 | 12/2003 | |
| WO | WO-0240391 | A1 * | 5/2002 | B67B 3/2033 |
| WO | WO 2007/106006 | | 9/2007 | |
| WO | WO 2011/029617 | | 3/2011 | |
| WO | WO 2014/060893 | | 4/2014 | |
| WO | WO 2014/176287 | | 10/2014 | |
| WO | WO 2016/116344 | | 7/2016 | |

OTHER PUBLICATIONS

International Search Report and Written Opinion for Application No. PCT/EP2016/050624, dated Apr. 14, 2016 in 5 pages.

International-Type Search Report for Swedish National Application No. 1550070-5, dated Aug. 21, 2015 in 5 pages.

International Search Report and Written Opinion for International Application No. PCT/EP2016/059933 dated Jul. 18, 2016 in 11 pages.

International-Type Search Report for National Application No. 1550588-6 dated Jan. 8, 2016 in 5 pages.

* cited by examiner

CAP ORIENTATION

TECHNICAL FIELD

The present invention relates to a method and apparatus for applying a cap to a container.

BACKGROUND

Screw caps for containers having a threaded neck portion have been known in the art for a very long time.

Usually, both the screw cap and the neck portion are made of polymer material, comprising one or more complementary threaded portions for screwing the cap onto the neck.

In the food packaging industry, containers and especially packaging containers with a bottle-like shape, having a body portion of a packaging material laminate and a top portion of polymer material including a threaded neck part are well known. Examples of such packaging containers are Tetra Top™, Tetra Evero™ and Tetra Evero Aseptic™ wherein the latter additionally comprises an oxygen barrier in the form of an aluminium foil as part of the packaging material laminate for longer storage time of the foodstuff contained in the packaging container.

After a web of paper material is laminated with several outer polymer materials, folded and spliced to form a hollow packaging container body, a top portion comprising threaded neck part is injection moulded onto the body, which may be of different material than the top portion as evident from the packaging containers mentioned in the previous paragraph. In the next step, a cap application unit screws a threaded cap usually made of polymer material onto threaded neck portion of the packaging container comprising complementary threads. In the ensuing step, the hollow side of the packaging container is filled with the foodstuff to be contained whereafter the hollow end of the container is folded and sealed. It should be mentioned, that in one possible and known implementation of the capping process, the hollow packaging container body including the injection moulded top portion is fed into a rotating drum and rotated to face a screw cap holder while at a distance a screw cap is fed to the screw cap holder. While both the packaging container and the screw cap holder are locked in their radial positions, the screw cap is rotatingly moved towards the top portion of the packaging container and screwed onto its neck portion.

Experience shows that a small percentage of the thus capped package containers display a misalignment between the cap and the neck part of the container. However, the problem exists also for other types of containers, where the top and the body portion are made of the same material, such as a polymer material. Such misalignment has the effect of not sufficiently sealed container, damaged threaded portions on the neck part and the cap itself or too easy opening of the container. Containers with these deviations need to be discarded.

It can be shown that besides reasons mentioned and dealt with in a pending application filed by the applicant, one reason for the misalignment problem lies in the path length the cap has to travel before it hits the start of a thread on the threaded neck portion of the container. Especially in the case when at least one of the threads in the cap may hit the start of either one of two threads on the threaded part of the container neck, obliquely applied or tilted caps are likely to occur.

SUMMARY

One solution according to the present invention is given by independent claim 1.

The solution is a method for applying a cap to a container, comprising arranging a first cap in relation to the neck portion of a first container, such that a threaded portion of the first cap faces a complementary threaded neck portion of the first container and such that a symmetry axis of the first cap and a symmetry axis of the neck portion of the first container are aligned. Then the first cap is rotated around its symmetry axis to a pre-recorded initial angular position. Thereafter, the first cap is applied to the neck portion by moving it towards the threaded neck portion or vice versa along their symmetry axes and by rotating the first cap in a direction of engagement with the threaded neck portion. Then the path length of the first cap is recorded in relation to its initial angular position after which it has completely engaged the complementary threaded neck portion and reached a bottom part of the neck portion. In case the recorded path length of the first cap deviates from a predefined threshold value, the relative angular position of a second cap is adjusted to a new relative angular position.

In this way, if the path length is changing from decreasing trend to increasing path lengths, this is a sign that a certain critical value has been reached for a certain relative angle and that this relative angle should be adjusted a safe angular distance from this critical area. Using the solution according to the method of the present invention the percentage of discarded containers due to obliquely applied caps can be reduced.

Preferred embodiments are listed in the dependent claims 2-7.

Another aspect of the solution according to the present invention is presented in independent claim 8.

This solution is given by an apparatus for applying a cap to a container, which comprises a holder configured for arranging a first cap in relation to neck portion of a first container, such that a threaded portion of the first cap faces a complementary threaded neck portion of the first container, and such that a second symmetry axis of the holder and a symmetry axis of the neck portion of the first container are aligned. The apparatus also comprises a drive unit configured for rotating the holder and thus the first cap around its second symmetry axis to pre-recorded initial angular position, where the drive unit is further configured to apply the first cap to the threaded neck portion of the first container by instructing the holder to move the first cap in a direction of engagement with the threaded neck part. Also, the apparatus comprises a processing unit configured for recording a path length of the first cap in relation to its initial angular position after which the first cap has completely engaged the threaded neck portion of the first container and reached a bottom part of the neck portion. Furthermore, the processing unit configured for instructing the drive unit to adjust the relative angular position of the holder for a second cap to a new relative angular position in case the recorded path length of the first cap deviates from a predefined value.

Thus, using the apparatus according to the present invention, a notable decrease in discarded containers due to the cap application problems mentioned earlier can be achieved.

Preferred embodiments of the apparatus are listed in the dependent claims 9-15.

DRAWINGS

FIG. 1 displays one embodiment of the apparatus for applying a cap to a container seen in a perspective view.

Figure 2A:
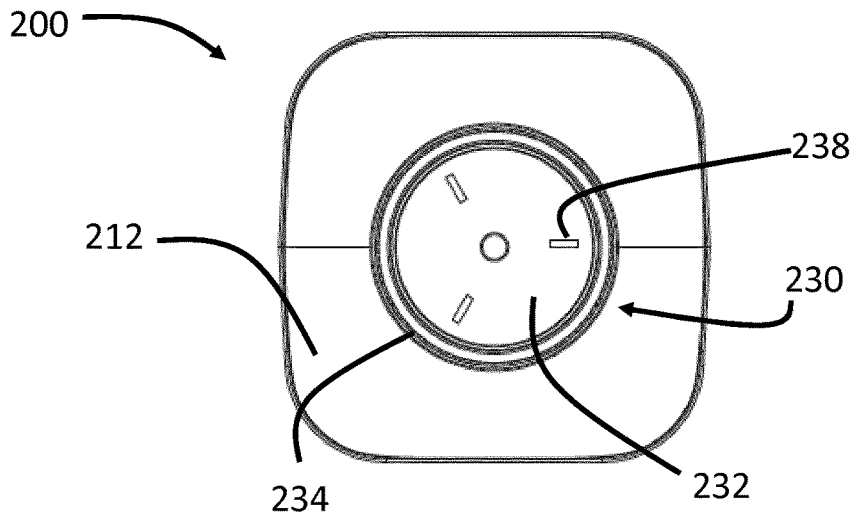

FIG. 2*a* displays a cap and a part of a container in a top view, with a first starting angle for the cap.

Figure 2B:
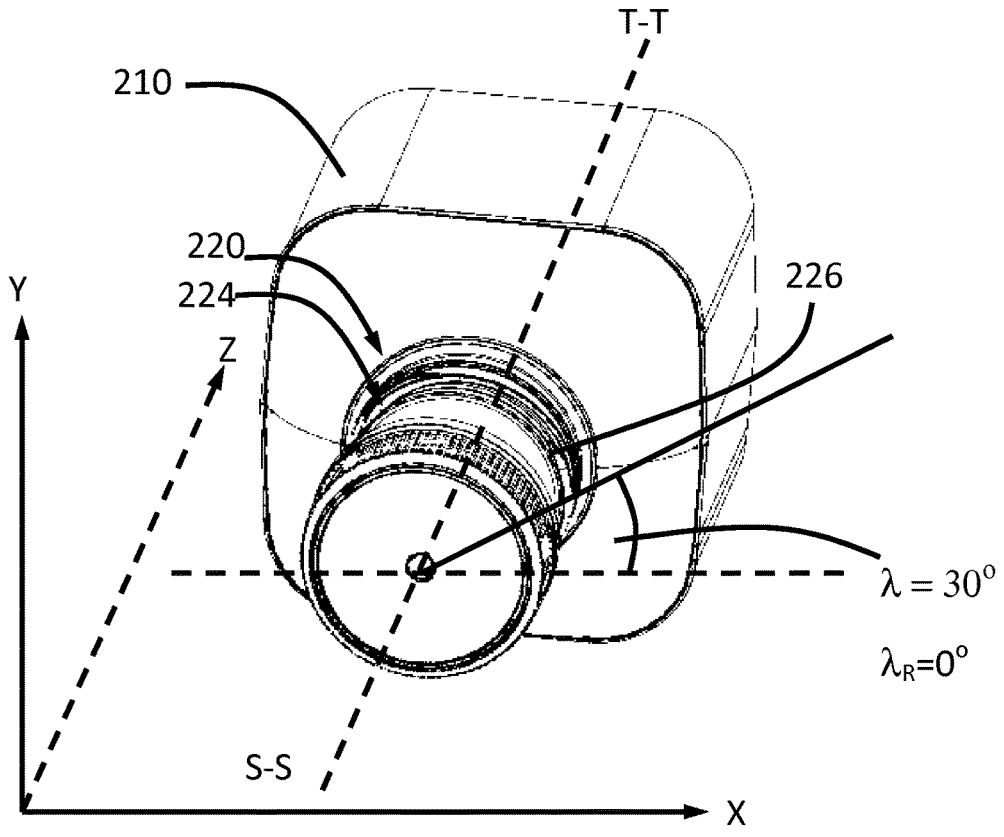

FIG. 2*b* displays the cap and container from FIG. 2*a* in a perspective view.

Figure 2C:
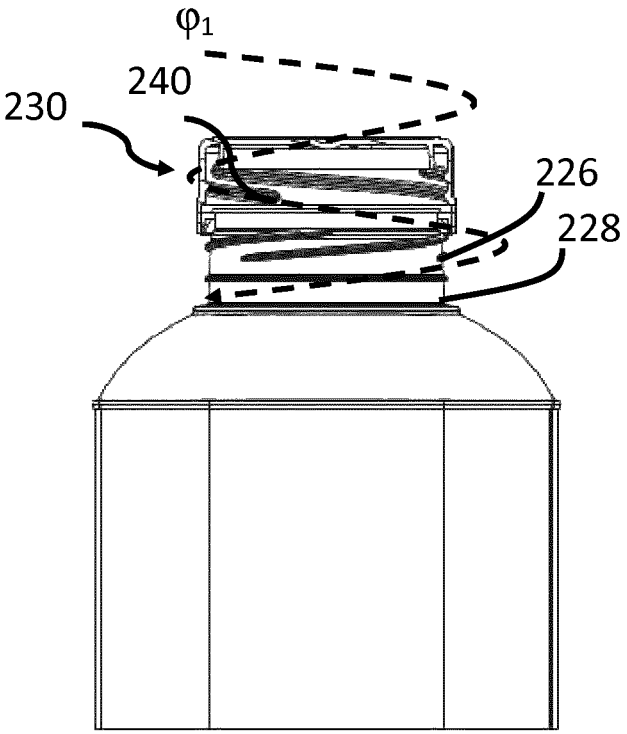

FIG. 2*c* displays the cap and container form FIG. 2*a* in a sectional view where the threaded portion of the cap and the complementary threaded neck portion of the container are shown in more detail.

Figure 3A:
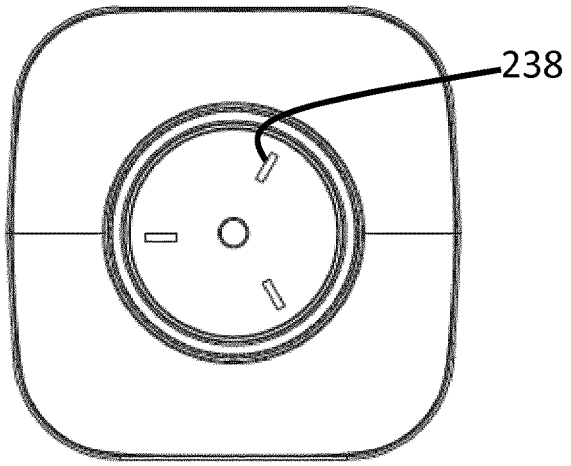

FIG. 3*a* displays a cap and a top portion of a container in a perspective view, with a second starting angle for the cap.

Figure 3B:
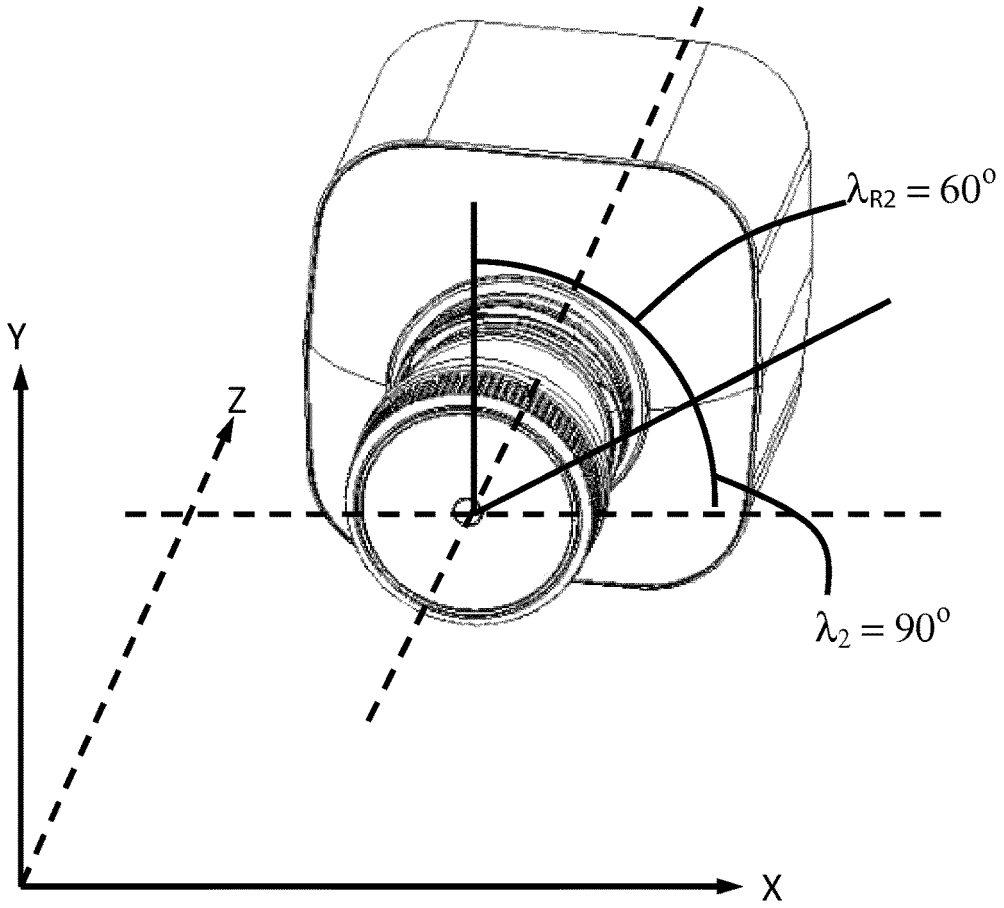

FIG. 3*b* displays the cap and the container from FIG. 3*a* in a perspective view.

Figure 3C:
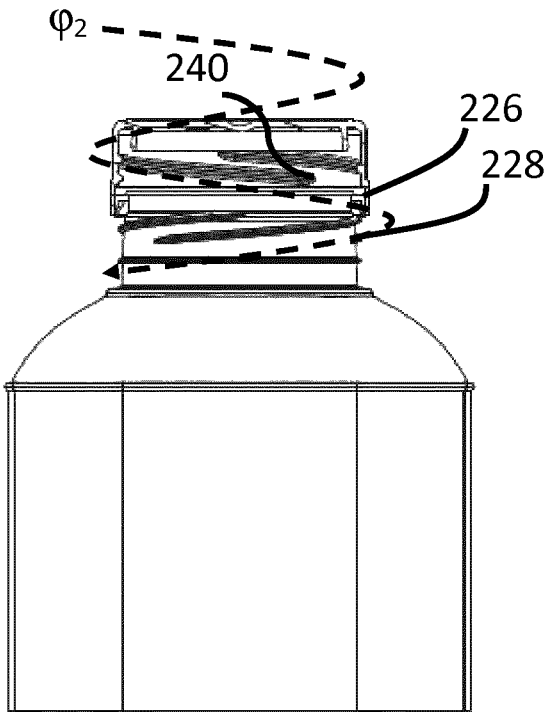

FIG. 3*c* displays the cap and the container from FIG. 3*a* in a sectional view where the threaded portion of the cap and the threaded neck portion of the container are shown in more detail.

FIGS. 4*a*-4*d* display a sequence of increasing start angles for the cap to be screwed onto the container in order to find a safe start angle according to one embodiment of the method of the present invention.

Figure 5:
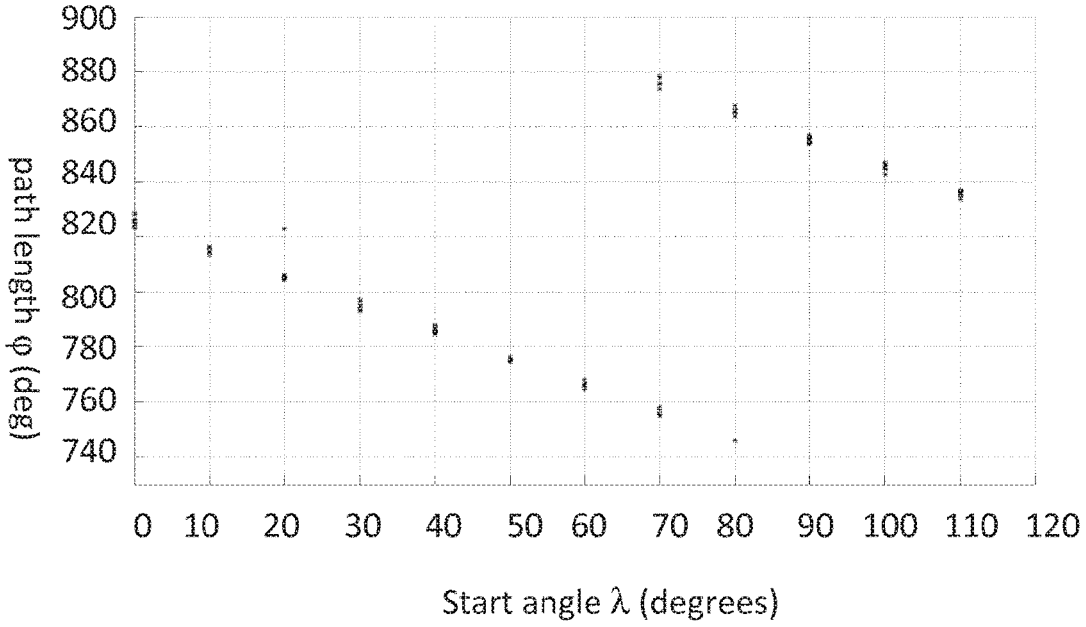

FIG. 5 displays a diagram showing path length travelled by the cap until the cap has completely closed the neck portion of the container as a function of the starting angle of the cap.

Figure 6:
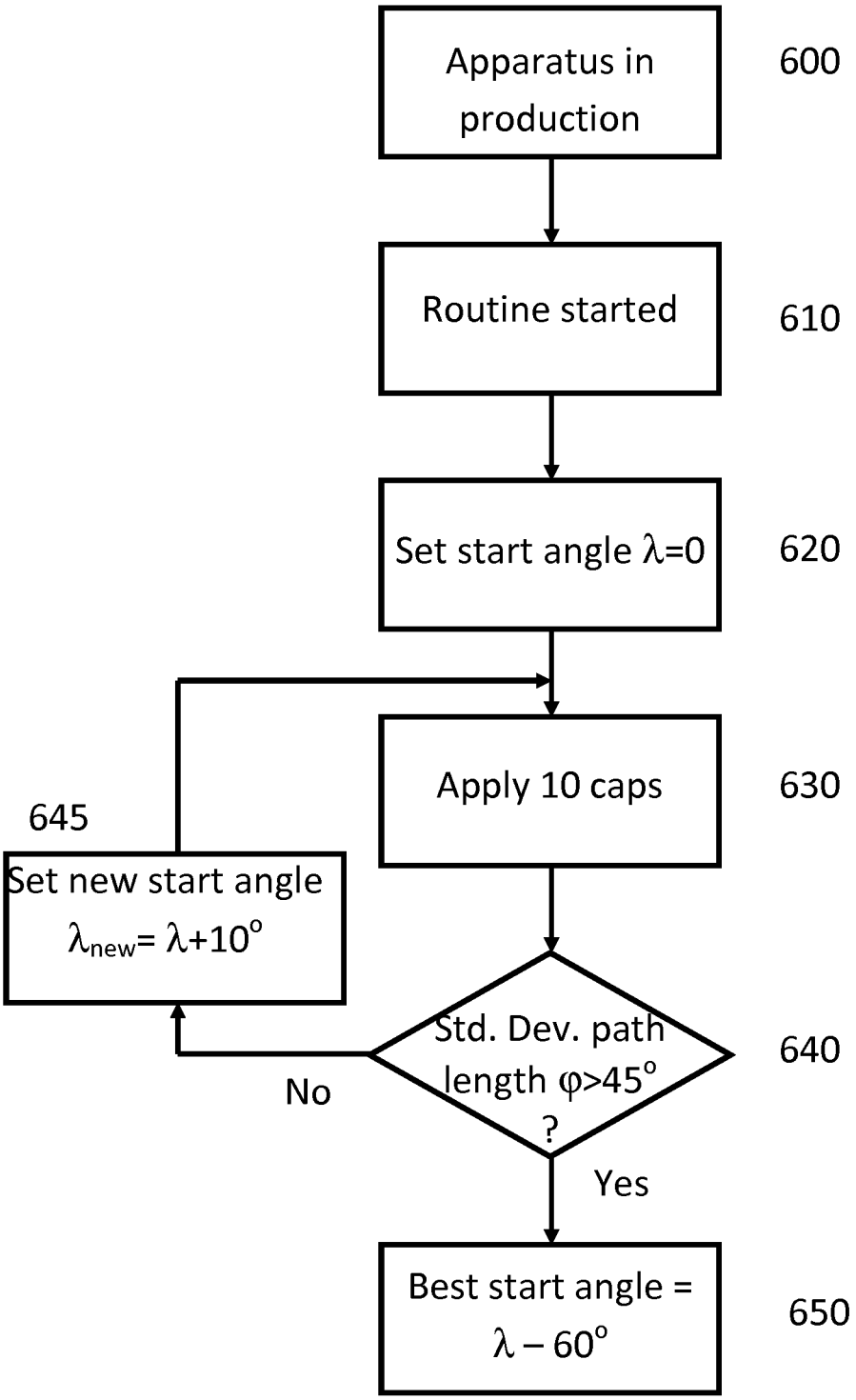

FIG. 6 displays a flow chart illustrating one example of the method for applying a cap to a neck portion of a container.

DETAILED DESCRIPTION

Embodiments of the present invention will be described in more detail below with reference to the accompanying drawings in order for those skilled in the art to be able to carry out the invention. The invention may, however, be embodied in many different forms and should not be construed as limited to the embodiments set forth herein. Ultimately, the present invention is only limited by the appended patent claims. Furthermore, the terminology used in the detailed description of the particular embodiments illustrated in the accompanying drawings is not intended to be limiting for the invention.

FIG. 1 displays an example apparatus 100 for applying a cap to a neck portion of a container. In this example, the container is a so called packaging container where the body portion is made of a web of packaging material with a top portion made of polymer material. It shall be noted, however, that the solution presented in the claims is also applicable to other types of containers, where the body and top portion may be made of the same material, such as a polymer. Moreover, it should be mentioned here that once the packaging laminate web is cut and raised into a hollow packaging container body and once a polymer portion comprising a threaded neck portion is injection moulded on top of the packaging container, such a raised container is forwarded to the apparatus 100. The apparatus 100 comprises a drum 130 rotatable around an axis A-A and which comprises tubular openings 132 for receiving packaging containers. Moreover, the apparatus 100 comprises a stripper unit 110 which feeds the packaging containers from the drum 130 onto a capping station where a cap is applied to threaded neck portion of the packaging container. The stripper unit 110 then moves the packaging container away from the capping station 120 and places a new packaging container there. While a new packaging container is fed to the capping station 120, a cap application unit 140 moves downward along the B'-B' axis and forward along the C-C axis in the direction of the arrows in FIG. 1 (forward meaning towards the drum 130) to pick up a screw cap from a cap handling unit (not shown). The cap is fed on a piston (not shown) into a cap holder or chuck 150. The radial position of the screw cap holder is recorded by a processing unit 160 which is connected to the cap holder 150. Then, the screw cap application unit 140 moves backward along the A-A axis (i.e. away from the drum 130), up along the B'-B' axis in the direction of the arrows, and along the B-B axis in order to position the cap holder 150 holding the screw cap in front of the package in the capping station 120. The processing unit 160 instructs a drive unit (not shown) for the cap holder 150 to rotate chuck and thus the screw cap to the pre-recorded position. Finally, the screw cap application unit 140 rotates the cap holder 150 while the packaging container is moved towards the cap holder 150. In this fashion the cap held in the cap holder 150 is screwed onto the threaded neck portion of the packaging container. Once the screwing step has been completed, the stripper unit 110 moves the thus closed packaging container away from the capping station 120 to the package filling step where the packaging containers, which are hollow on the end opposite the cap end, are filled with foodstuff and where the open end of the packaging container is folded together and sealed. At the same time a new packaging container is fed to the capping station 120 and the cap application cycle starts all over again. During the final step of the cap application process, the processing unit monitors the angular path length travelled by the cap from its initial angular position until the cap has completely closed a threaded neck portion of the container and reached the bottom of the neck portion. The processing unit 160 then instructs the drive unit of the cap holder 150 to adjust its initial rotational position to a new rotation position until a certain threshold value for the path length has been exceeded or until there is a change in path length from a decreasing path length to an increasing path length. This will be explained more in detail in the description of FIGS. 5 and 6.

FIGS. 2*a*-2*c* display a cap 230 and a top part of a container 200 which is to be closed by the cap 230. The cap 230 comprises a bottom portion 232 with markings 238 and a raised annular portion 234 in contact with the bottom portion 232. The cap 230 also comprises one or more threads 240, such that the cap 230 may be used to close a neck portion 220 of the container 200 comprising a complementary threaded portion 224. In this specific example, the cap 230 comprises three markings 238 positioned on the bottom portion 232 of the cap 230 facing the interior of the neck portion 220 of the container 200. The three markings 238 are positioned at a certain radial distance from the center of the cap 230 and spaced apart by an angle of essentially 120° from each other. Each marking 238 is radially aligned with the start of a thread 240 on the cap 200, meaning that in this example the cap 230 comprises three threads. Moreover, the example displays a container 200, which is shown as a packaging container, made of a body 210, of which a part is shown, and a top consisting of top portion 212 and a neck portion 220 comprising the complementary threaded portion 224 which is complementary to the threads of the 240 of the cap 230. The situation displayed in FIG. 2*b* occurs after the cap 230 has been fed to a cap holder (not shown) and when the cap holder has moved the cap 230 to a position where symmetry axes of the cap 230 (S-S) and the neck portion 220 (T-T) of the container 200 are aligned. This is the situation just before the container is moved towards the cap and before the cap holder has started to rotate the cap 230 towards the neck portion 220 of the container 200.

This position of the cap 230 may be set as its initial angular position, where the angle $\lambda_1$ is measured as the angle in the X-Y-plane between the start of the cap thread and the X-axis. In the case depicted in FIG. 2*b* the initial angular position $\lambda_1$ of the cap 230 is 30°. Since any further angular rotation of the cap 230 around its symmetry axis S-S is measured in relation to this initial angular position, a relative initial angular position may be defined as $\lambda_{R1}$=0°. Now, when the cap 230 is to be applied to the container 200, usually the raised container 200 with the neck portion 220 is fed by a stripper unit shown in FIG. 1 towards the cap 230. Usually, the thread or threads on the cap 230 have to travel a certain path length over the complementary threaded neck portion 240 until they close the container 200 and until the cap 230 has reached the bottom 228 of the neck portion 220 of the container 200. One may measure the path length as the angular rotation φ of the cap around its symmetry axis S-S from its initial position until it the cap 230 has reached the bottom of the neck portion 220 of the container 200, i.e. This path length is dependent on when the thread of the cap hits the start 226 of the complementary thread on the neck portion 224 of the container 200. If the start of the cap thread 240 hits the start 226 of the complementary thread on the neck portion 224 of the container 200 right away it will result in a shorter path length φ than in cases where the cap thread 240 hits the complementary threaded portion a distance away from its starting point.

FIG. 3 displays the same cap and container as shown in FIG. 2, so same reference signs will not be repeated here. In this example, the cap 230 has been moved from its relative initial angular position $\lambda_{R1}$=0° to a new relative angular position $\lambda_{R2}$=60°, i.e. the cap 230 has been rotated in relation to the relative initial starting angle by 60°. The absolute value of the new angular position is thus $\lambda_{R2}$=90°. This adjustment will result in a change of path length reducing or increasing it from the situation with the relative initial start angle $\lambda_{R1}$=0°. This new path length $\varphi_2$ will depend on where the cap thread 240 hits the start 226 of the complementary thread on the neck portion 220 of the container. As will be shown in the diagram in FIG. 5, sudden changes in path lengths measured may be indicative of a problematic area in the cap application process.

Figure 4A:
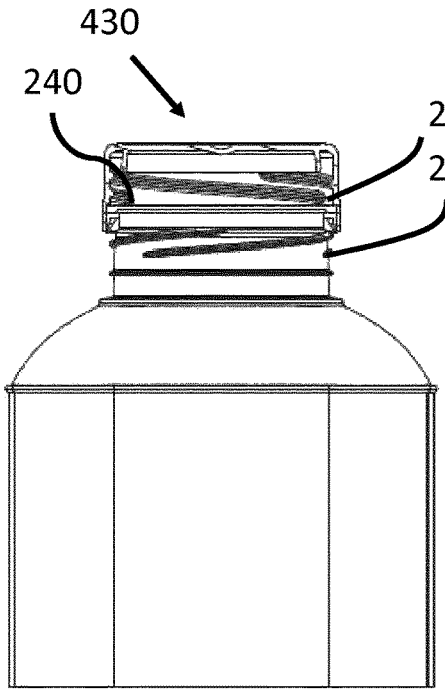

FIGS. 4*a*-4*d* display the influence of the change in relative initial start angle $\lambda_R$ for the cap on the path length φ travelled. In FIG. 4*a* a relative starting angle $\lambda_{R1}$=0° is chosen for the first cap 430, which in this case is assumed to in relation to the initial starting angle for the first cap 430 recorded by the processing unit during the cap feeding position of the holder. Although every apparatus for applying a cap to a neck portion of a container may have different path lengths for the same relative starting angle and thus the "critical" relative starting angles causing obliquely applied caps may vary, we assume here that a starting angle $\lambda_{R1}$=0° is in a "safe area". It should also be mentioned that the critical starting angle not only depends on each individual apparatus, but also on the cap size and type.

Thus using the relative starting angle $\lambda_{R1}$=0° we will get a first path length $\varphi_1$.

Figure 4B:
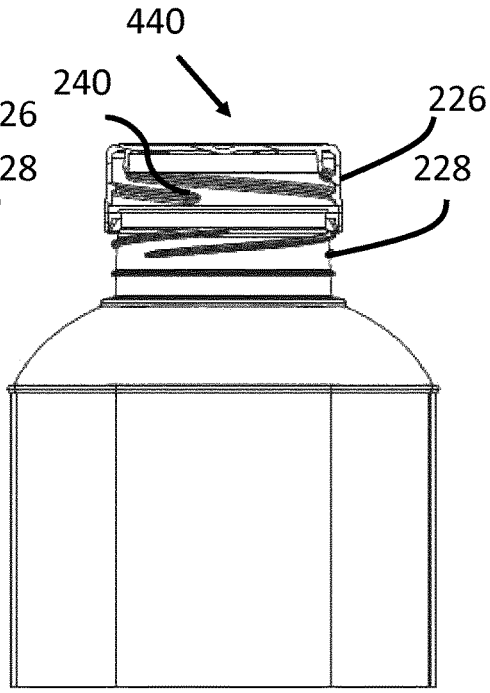

In FIG. 4*b* a relative starting angle $\lambda_{R2}$=40° is chosen, meaning that the second cap is adjusted by +40° from the initial angular position of the first cap 430. It is already clear from the figure that the path length $\varphi_2$ for the second cap 440 will be shortened, since the start of one of the threads 240 on the second cap 430 will hit the start of the complementary thread on the threaded neck portion 228 earlier.

Figure 4C:
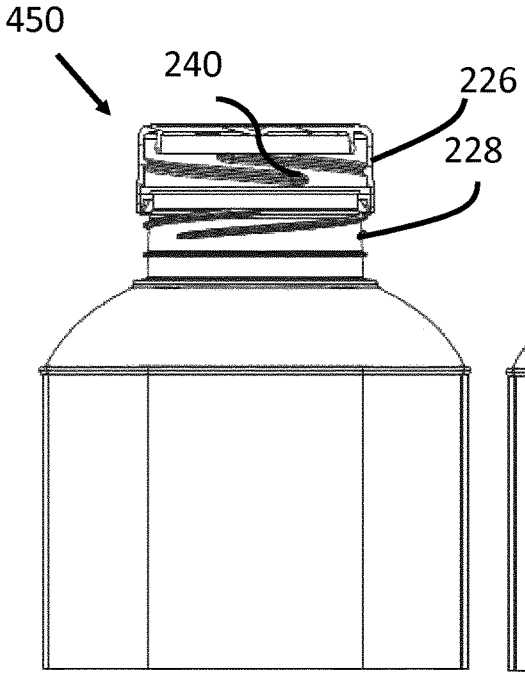

In FIG. 4*c* a relative starting angle $\lambda_{R3}$=80° is chosen for the third cap 450. In this case it is likely that the start of one of the threads 240 on the third cap 450 will miss the start of the first complementary thread on the threaded neck portion 228 and thus engage the second complementary thread instead. The relative starting angle is thus in an area where also one of the threads of third cap 450 during its application onto the neck portion of the container may also position themselves between two threads on the neck portion of the container resulting in a obliquely applied cap. In this scenario, a relative starting angle $\lambda_{R3}$=80° will result again in a longer path length $\varphi_3$. The processing unit will detect the change to longer path length and instruct the drive unit to adjust the relative starting angle $\lambda_{R3}$ to a safe value, which in this case may be somewhere between +/−45° to +/−60° from the initial starting angle of the first cap 430.

Figure 4D:
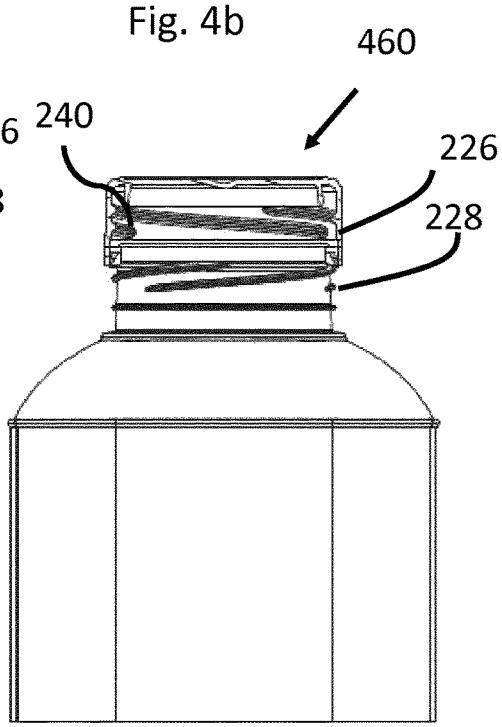

In FIG. 4*d* a relative starting angle $\lambda_{R4}$=120° is chosen for the third cap 450 resulting in a reduction of the path length $\varphi_4$ for the fourth cap 460 as it is the same situation as for the relative starting angle $\lambda_{R1}$=0° for the first cap. We assume here that in all cases illustrated in FIGS. 4*a*-4*d* the caps have three threads where the starting points of each thread have an angular separation from each other by 120°.

FIG. 5 displays a simulation diagram performed on a real cap application apparatus showing the dependence of the path length φ travelled as a function of the start angle λ for the cap. The cap in this simulation had three threads the start of each being separate by an angular distance of 120°. The path length φ in this example was calculated as the standard deviation from a set of 10 caps applied with the same start angle λ. One can see a steady reduction in the path length φ travelled by the with increasing start angles in the interval λ=0°-70°. Then, there is a sudden jump in the path length φ travelled by the cap indicating that the thread of the cap has "missed" the start of the first complementary thread on the neck portion of the container and travelled a path length φ=120° hitting the start of the next thread on the threaded portion on the container. It is usually here that tilted caps occur and where such containers have to be discarded. It should be mentioned here that the diagram in FIG. 4 is specific to the type of cap and neck portion of the container used in the examples in FIGS. 1-3. However, since the present invention is not limited to only one type of cap having a specific number of threads or to one type of container with a specific neck portion having complementary threads, the diagram may show a different relation between the start angle λ and the path length φ travelled for other such caps.

FIG. 6 displays a flow chart illustrating an example embodiment of the method according to the present invention.

At step 600 the cap application apparatus, such as the apparatus 100 in FIG. 1 is started for production of capped containers.

Thereafter, at step 610, a cap application routine is started involving several sub-steps. These sub-steps are for convenience described in a summary way, since they are not an essential part of the present invention. It should also be mentioned here, that the cap application method is not limited to one specific apparatus only, since the generally principles of the invention as defined in the appended claims may be implemented on any cap application apparatus where alignment between the threads of the cap and a threaded neck portion of the container to which the cap is to be applied, is an issue.

Returning to the application routine mentioned in step 610, a cap holder, such as the cap holder 150 in the apparatus 100 in FIG. 1 receives a cap of unknown orientation from a feeding unit of the apparatus and rotates the cap holder and thereby the cap until engagement with a tool of the feeding unit. The cap and the tool may be endowed with complementary recess and protrusions so that there is a point of engagement between the cap and the tool. The angular position of engagement may then be registered by a processing unit, such as the processing unit 160 for later use in the cap application step. After this sub-step, the cap orientation is known. After engagement, a drive unit of the cap holder instructs the drive holder to rotate in a direction away from the engagement with the tool of the feeding unit and to move the tool holder into the cap application position. In this position shown in FIGS. 2*b* and 3*b*, the cap faces the neck portion of the container, such that their symmetry axes are aligned. Also, the processing unit instructs the drive unit of the cap holder to rotate the cap holder into the previously registered position where engagement with the tool of the feeding unit was achieved.

This position at step 620 is defined as the relative initial angular position $\lambda_{R1}=0°$ of the cap. What is unknown in this position is the angular position of the threads on the cap in relation to the threads on the neck portion of the container onto which the cap is to be applied.

Although, this angular position is not determined directly a path length the cap has to travel until it hits the bottom of the neck portion of the container is readily measurable. This path length depends on the position at which the cap threads hit the start of the complementary threads on the threaded neck portion of the container.

Furthermore, as already described in FIG. 5, for an example cap of a certain size with three threads and a neck portion with three complementary threads, where the start of each of the thread is separated by an angle of 120°, there is a critical relative starting angle dramatically affecting the path length, which is located somewhere between $\lambda_R=60°$ and $\lambda_R=70°$ where there is a risk that the cap thread or threads hit a threaded neck portion of the container such they hit a spot between two different threads on the neck portion and the cap thus becomes obliquely applied to the container leading to discarded containers.

In order to detect that critical relative start angle, the processing unit instructs the apparatus to apply a certain number of caps with the same relative start angle $\lambda_R=0°$.

Thus, at step 630, the processing unit instructs the apparatus to apply 10 caps using the initial angular position or relative initial start angle $\lambda_R=0°$ and to determine the path length $\varphi$, i.e. the angular distance the cap has to travel in order reach the bottom of the neck portion of the container. This is practically calculated by the processing unit as the standard deviation for the path length at that relative start angle $\lambda$. However, other calculation methods may also be possible.

At step 640 the processing unit compares the registered path length $\varphi$ with a predefined threshold value. This threshold value may vary for different types of caps and from machine to machine and may be set by the operator. In this specific example, the threshold value is selected as the threshold standard deviation and set to $\varphi_T=60°$ (a path length difference of 120° for two consecutive start angles). In order to have a safe margin from the jump in path length which occurs for relative start angles $\lambda_R$ somewhere between 60° and 70°, the safe relative angle is chosen to be 45°. If the path length difference in this example is determined to be longer than 45° the processing unit instructs the drive unit to rotate the cap holder and thus the cap away from this critical area to a start angle that is safe, i.e. to a start angle which eliminates or minimizes containers with tilted caps.

In this specific example, the processing unit instructs the drive unit at step 650 to rotate the cap holder and thus the cap by −60° from the previous relative start angle to be on the safe side. For other cap sizes and types and for other machines this value may be different.

However, if the processing unit at step 640 has determined that the path length $\varphi$ is less than the threshold value, then it instructs the drive unit at step 645 to rotate the cap holder by a certain angle increment in order to determine which starting angle is the closest to the problematic are. In this example, the angle increment is 10°.

Thereafter, the apparatus applies the next 10 caps to the corresponding neck portions of containers and checks again if the standard deviation of the path length is higher that the predefined threshold value.

The example method in FIG. 6 may be initiated by an operator each time there is a change of cap size, since the starting angles, path lengths and threshold values may have changed.

However, this may also be done automatically by the apparatus under instruction form the processing unit, which may have a data base of threshold path lengths for each cap size and type in order to account for cap size and type changes. Also, the angle increments and the number of caps having the same starting angle may be modified an operator depending on the application.

It should be stated here that the present invention should be interpreted as being limited by the example embodiments described herein which only serve as illustrative examples only. The present invention is ultimately only limited by the scope of the appended claims.

The invention claimed is:

1. A method of applying a cap to a container, the method comprising:

arranging a first cap in relation to a neck of a first container such that a threaded portion of the first cap faces a complementary threaded portion of the neck of the first container and such that a first axis extending through a center of the first cap aligns with a second axis extending through a center of the neck of the first container;

rotating the first cap around the first axis to a first angular position;

applying the first cap to the neck by moving the threaded portion of the first cap towards the complementary threaded portion of the neck of the first container or by moving the complementary threaded portion of the neck of the first container towards the threaded portion of the first cap along the aligned first and second axes and by rotating the threaded portion of the first cap about the first axis in a direction of engagement with the complementary threaded portion of the neck of the first container;

recording, with a processing unit, a path length of the first cap with respect to the first angular position, the path length representative of an angular rotation of the first cap about the first axis from the first angular position to a final angular position, wherein, at the final angular position, the threaded portion of the first cap completely engages the complementary threaded portion of the neck of the first container and the first cap reaches a bottom part of the neck of the first container;

comparing, with the processing unit, the recorded path length of the first cap with a threshold value; and determining a second angular position of a second cap with respect to the first angular position of the first cap and rotating the second cap through an angle increment to a third angular position when the recorded path length of the first cap deviates from the threshold value, wherein the step of determining the second angular position of the second cap is performed by the processing unit.

2. The method according to claim 1, wherein the angle increment is 60°.

3. The method according to claim 1, wherein the rotation of the second cap is performed after a plurality of caps after the first cap have been applied to a neck of a corresponding container.

4. The method according to claim 3, further comprising adjusting angular positions of the plurality of caps with respect to the first angular position of the first cap in predefined incremental rotational angle steps subsequent to the step of recording the path length of the first cap.

5. The method according to claim 4, wherein the predefined incremental rotational angle steps comprise steps of 10 degrees from a relative angular position of a previous cap.

6. The method according to claim 3, further comprising:

recording a plurality of path lengths of the plurality of caps after application to the neck of the corresponding container;

determining a standard deviation of the plurality of path lengths; and comparing the standard deviation with the threshold value.

7. The method according to claim 6, wherein the threshold value is +/−60°.

8. An apparatus for applying a cap to a container, the apparatus comprising:

a cap holder configured to arrange a first cap in relation to a neck of a first container such that a threaded portion of the first cap faces a complementary threaded portion of the neck of the first container and such that a first axis extending through a center of the cap holder aligns with a second axis extending through a center of the neck of the first container;

a drive unit configured to rotate the cap holder and the first cap around the first axis to a first angular position, the drive unit further configured to apply the first cap to the threaded portion of the neck of the first container by instructing the cap holder to move the first cap in a direction of engagement with the threaded portion of the neck of the first container; and a processing unit configured to:

record a path length of the first cap with respect to the first angular position, said path length representative of an angular rotation of the first cap about the first axis from the first angular position to a final angular position, wherein, at the final angular position, the threaded portion of the first cap completely engages the threaded portion of the neck of the first container and the first cap reaches a bottom part of the neck of the first container;

compare the recorded path length of the first cap with a threshold value; and determine a second angular position of the cap holder for a second cap with respect to the first angular position and instruct the cap holder to rotate the second cap through an angle increment to a third angular position when the recorded path length of the first cap deviates from the threshold value.

9. The apparatus according to claim 8, wherein the drive unit is further configured to move the cap holder from a cap feeding position to a cap application position.

10. The apparatus according to claim 9, wherein the cap application position is a position where the first axis of the cap holder and the second axis of the neck of the first container are aligned.

11. The apparatus according to claim 9, further comprising a cap application unit configured to provide the first cap to the cap holder when the cap holder is in the cap feeding position.

12. The apparatus according to claim 8, wherein the drive unit is further configured to rotate the first cap until engagement with a cap application unit carrying the first cap.

13. The apparatus according to claim 12, wherein the processing unit is further configured to register the first angular position of the cap holder and thus the first cap during engagement with the cap application unit.

14. The apparatus according to claim 8, wherein the angle increment is 60°.

15. The apparatus according to claim 8, wherein the angle increment is 10°.

16. The method according to claim 6, wherein the threshold value is +/−45°.

17. The method according to claim 1, wherein the angle increment is 10°.

* * * * *